US005718387A

United States Patent [19]

Awarzamani et al.

[11] Patent Number: 5,718,387

[45] Date of Patent: Feb. 17, 1998

[54] FUEL INJECTION VALVE

[75] Inventors: Assadollah Awarzamani, Markgroeningen; Norbert Belzner, Heilbronn, both of Germany

[73] Assignee: Robert Bosch GmbH, Stuttgart, Germany

[21] Appl. No.: 573,108

[22] Filed: Dec. 15, 1995

[30] Foreign Application Priority Data

Dec. 23, 1994 [DE] Germany ..... 44 46 241.7

[51] Int. Cl.[6] ..... F02M 51/06

[52] U.S. Cl. ..... 239/585.1; 239/600

[58] Field of Search ..... 237/585.1, 585.2, 237/585.3, 585.4, 585.5, 583, 584, 596, 552, 533.1, 533.2, 533.12, 533.14, 533.3, 900, 600; 251/129.15, 129.18

[56] References Cited

U.S. PATENT DOCUMENTS

| | | | |
|---|---|---|---|
| 5,002,231 | 3/1991 | Reiter et al. | 239/585.1 |
| 5,193,743 | 3/1993 | Romann et al. | 239/585.5 |
| 5,263,648 | 11/1993 | Vogt et al. | 239/585.1 |
| 5,273,215 | 12/1993 | Hans et al. | 239/288.5 |
| 5,323,966 | 6/1994 | Buchholz et al. | 239/408 |
| 5,335,864 | 8/1994 | Romann et al. | 239/585.1 |
| 5,381,957 | 1/1995 | Bianco | 239/552 |
| 5,395,050 | 3/1995 | Nowak et al. | 239/121 |
| 5,540,837 | 7/1996 | Reiter et al. | 239/408 |
| 5,570,843 | 11/1996 | Heyse et al. | 239/585.1 |

FOREIGN PATENT DOCUMENTS

| | | |
|---|---|---|
| 38 41 142 | 6/1990 | Germany . |
| 41 23 692 | 1/1993 | Germany . |

*Primary Examiner*—Andres Kashnikow
*Assistant Examiner*—Lisa Ann Douglas
*Attorney, Agent, or Firm*—Kenyon & Kenyon

[57] ABSTRACT

A perforated-disk carrier is provided on the fuel injection valve downstream of the valve seat surface, the perforated-disk carrier having an inner, dish-shaped carrier section into which a multiplicity of perforated disks with different dimensions can be inserted. To achieve this end, the cup-shaped perforated-disk carrier rests partially against the lower end of the valve seat body exhibiting the valve seat surface and is rigidly connected to the body. In the installed condition, the perforated disk, which is selected in accordance with the corresponding requirements and is inserted in the carrier section, likewise rests against the lower end of the valve seat body. The fuel injection valve is particularly suitable for fuel injection systems of mixture- compressing, applied-ignition internal combustion engines.

12 Claims, 4 Drawing Sheets

FUEL INJECTION VALVE

BACKGROUND INFORMATION

German Patent Application No. 38 41 142 describes a fuel injection valve in which a perforated disk is fixed to a valve seat body by means of an encircling weld. Here, the weld must be well away from the spray openings in order to avoid deformation of the perforated disk. The relatively thick perforated disk is of dish-shaped design to prevent the perforated disk from lifting off due to the prevailing fuel pressure, thereby changing the jet pattern of the fuel sprayed in an undesirable manner. The outlay for the production and installation of the perforated disk is very high.

German Patent Application No. 41 23 692 describes a fuel injection valve in which a thinner perforated disk is used, this in turn being supported by a thicker supporting disk following downstream of the perforated disk and having a central through-opening. In this way, unwanted bending of the perforated disk while it is being fixed is prevented. The supporting disk is of cup-shaped design and welded to the valve seat body together with the perforated disk by means of an encircling weld. The function of the supporting disk is primarily to improve the stability of the perforated disk and it is in each case rigidly connected to a perforated disk.

SUMMARY OF THE INVENTION

The fuel injection valve according to the present invention has the advantage that very good variation in the use of perforated disks with different dimensions, especially different thicknesses and diameters, is possible in a simple and economical manner, thereby making it possible with a low outlay to vary the flow rates through the perforated disks in a simple manner and also to generate different jet patterns. This is achieved, according to the present invention, by the provision, downstream of a valve seat surface, of a perforated-disk carrier with a carrier section shaped in such a way that a multiplicity of perforated disks with different dimensions can be inserted into it in a simple manner.

It is particularly advantageous to make the perforated-disk carrier cup-shaped and to connect its encircling retention rim leaktightly and rigidly to a valve seat carrier once the valve seat body has been placed in its axial position, thereby making it possible to adjust the valve stroke. It is also advantageous to make the bottom part of the perforated-disk carrier dish-shaped in order to accommodate a perforated disk precisely in this dish-shaped carrier section. This carrier section is advantageously of frustoconical or frustopyramidal design or constructed with a plurality of axially successive step sections.

It is likewise advantageous if means such as grooves or bead-like raised portions are provided in the carrier section of the perforated-disk carrier, their interaction with means positioned opposite them in corresponding fashion on the perforated disk guaranteeing defined installation positions and providing a safeguard against rotation.

The use of a perforated-disk carrier makes it possible to use perforated disks with comparatively small dimensions, advantageously making it possible to save on material for the perforated disks.

A particular advantage is also provided by the fact that the perforated disk to be installed is not connected rigidly either to the valve seat body or to the perforated-disk carrier, thus completely avoiding distortion of the perforated disk due to welding or other disadvantages resulting from conventional joining methods. There is complete separation between the different components as regards the operations of fixing (perforated-disk carrier) and metering (perforated disk). Because the perforated-disk carrier is a constant, it is possible to perform the same stroke-adjusting operation each time with the different perforated disks which can be used. It is thus possible to keep the scatter in the flow rate very small.

DETAILED DESCRIPTION

Figure 1:
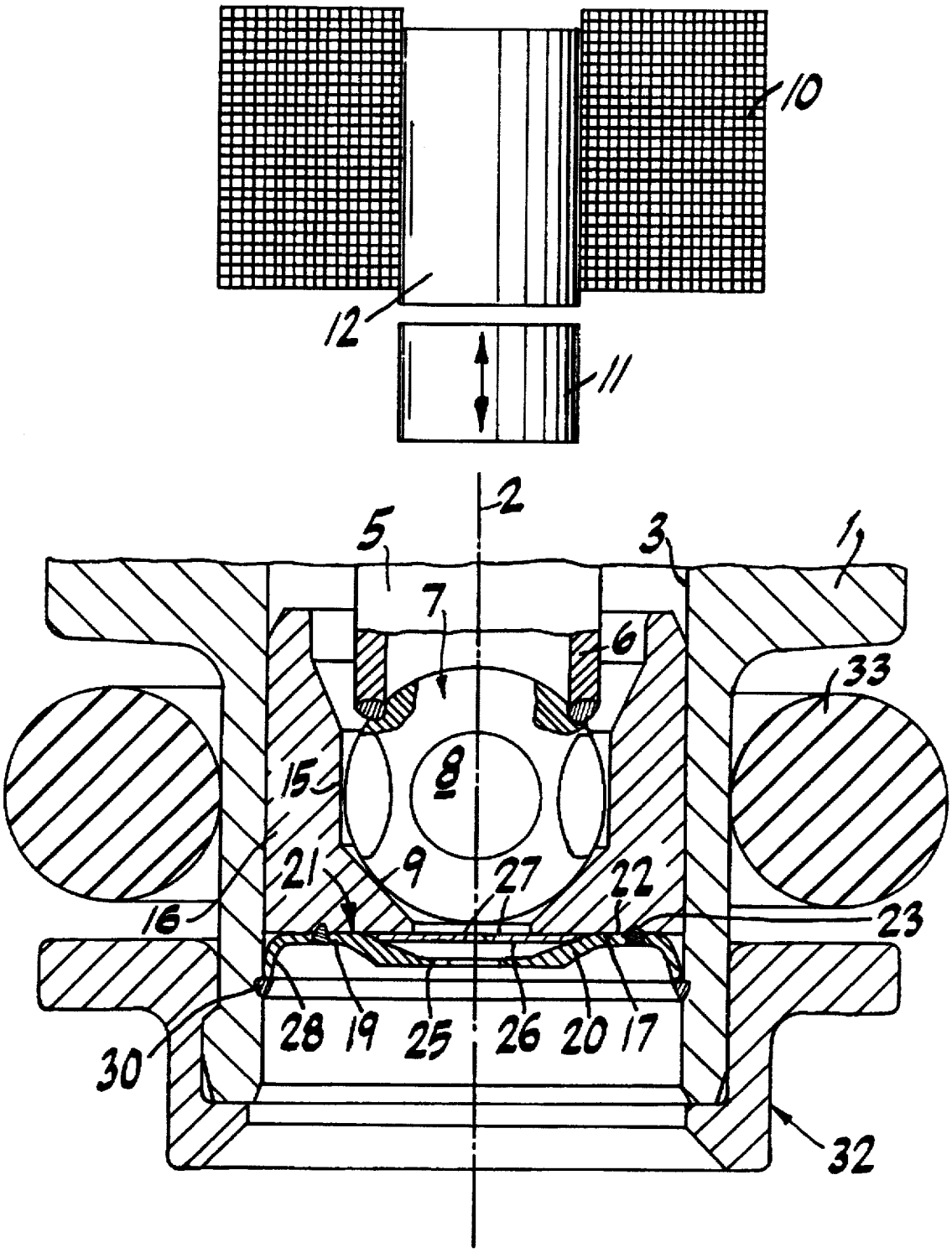
FIG. 1 shows an injection valve illustrated in part, according to the present invention.

FIG. 1 illustrates, as an exemplary embodiment, part of a valve in the form of an injection valve for fuel injection systems of mixture-compressing applied-ignition internal combustion engines. The injection valve has a tubular valve-seat carrier 1 in which a longitudinal opening 3 is formed concentrically with a valve Longitudinal axis 2. Arranged in the longitudinal opening 3 is a valve needle 5, which is, for example, tubular and, at its downstream end 6, is connected to a valve closing element 7, which is, for example, spherical and on the circumference of which there are, for example, five flats 8. The flats 8 on the valve-closing element 7 allow fuel to flow in the direction of a valve seat surface 9.

The injection valve is actuated in a known manner, electromagnetically for example. To move the valve needle 5 axially and hence open the injection valve counter to the spring force of a return spring (not shown) and close it, use is made of an electromagnetic circuit, which is indicated, comprising a solenoid 10, an armature 11 and a core 12. The armature 11 is connected to the end of the valve needle 5 remote from the valve-closing element 7 by means, for example, of a weld effected by means of a laser, and is aligned with the core 12.

To guide the valve-closing element 7 during the axial movement, use is made of a guide opening in a valve seat body 16. The cylindrical valve seat body 16 is arranged in the downstream end of the valve seat carrier 1, the end remote from the core 11, in the longitudinal opening 3 which runs concentrically with the valve longitudinal axis 2. The circumference of the valve seat body 16 has a slightly smaller diameter than the diameter of the longitudinal opening 3 in the valve seat carrier 1. At one end, its lower end 17, that facing away from the valve-closing element 7, the valve seat body 16 is rigidly and concentrically connected to an outer annular section 19 of a bottom part 20 of a perforated-disk carrier 21 according to the present invention, which, by virtue of its thickness, takes the form of a disk, and, in the region of the annular section 19, the bottom part 20 thus rests by its top side 22 against the lower end 17 of the valve seat body 16.

The valve seat body 16 and the perforated-disk carrier 21, which is, for example, of cup-shaped design, are connected, for example, by an encircling leaktight first weld 23, which is formed by means of a laser and necessarily extends in a ring on the annular section 19. Next to the outer annular section 19, the bottom part 20 has a lower-lying dish-shaped carrier section 25 which extends at an axial distance from the lower end 17 of the valve seat body 16 and into which is inserted a perforated disk 26. In the perforated disk 26 there is at least one and, for example, four spray openings 27 formed by punching or erosion. The way in which assembly is achieved and the formation of the weld 23 in the annular section 19 of the perforated-disk carrier 21 completely eliminate the risk of unwanted deformation of the bottom part 20 in its inner carrier section 25 and hence also of the perforated disk 26.

The bottom part 20 of the perforated-disk carrier 21, which is, for example, cup-shaped, is adjoined towards the outside by an encircling retention rim 28 which extends in the axial direction away from the valve seat body 16 and is bent outwards conically right up to its end. The retention rim 28 exerts a radial spring action on the wall of the longitudinal opening 3. This avoids the formation of a burr on the valve seat part and on the longitudinal opening 3 during insertion of the valve seat part comprising the valve seat body 16, the perforated disk 26 and the perforated-disk carrier 21. At it free end, the retention rim 28 of the perforated-disk carrier 21 is connected to the wall of the longitudinal opening 3 by, for example, an encircling and leaktight second weld 30.

Leaktight welding of the valve seat body 16 to the perforated-disk carrier 21 and of the perforated-disk carrier 21 to the valve seat carrier 1 is necessary in order to ensure that the medium employed, for example a fuel, cannot flow between the longitudinal opening 3 of the valve seat carrier 1 and the circumference of the valve seat body 16 or between the longitudinal opening 3 of the valve seat carrier 1 and the retention rim 28 of the perforated-disk carrier 21 directly into an intake line of the internal combustion engine.

The depth of insertion into the longitudinal opening 3 of the valve seat part comprising the valve seat body 16, the perforated disk 26 and the perforated disk carrier 21 determines the size of the stroke of the valve needle 5 since one end position of the valve needle 5 is determined, when the solenoid 10 is not excited, by the contact of the valve-closing element 7 with the valve seat surface 9 of the valve seat body 16. With the solenoid 10 excited, the other end position of the valve needle 5 is determined, for example, by the contact of the armature 11 with the core 12. The distance between the two end positions of the valve needle 5 thus represents the stroke.

The spherical valve-closing element 7 interacts with the valve seat surface 9 of the valve seat body 16, the valve seat surface tapering frustoconically in the direction of flow and being formed axially between the guide opening 15 and the lower end 17 of the valve seat body 16.

A protective cap 32 is arranged on the circumference of the valve seat carrier 1 at its downstream end, the end remote from the solenoid 10, and is connected to the valve seat carrier 1 by means of a snap connection, for example. A sealing ring 33 serves to provide a seal between the circumference of the injection valve and a valve holder (not shown), for example the intake line of the internal combustion engine.

Figure 2:
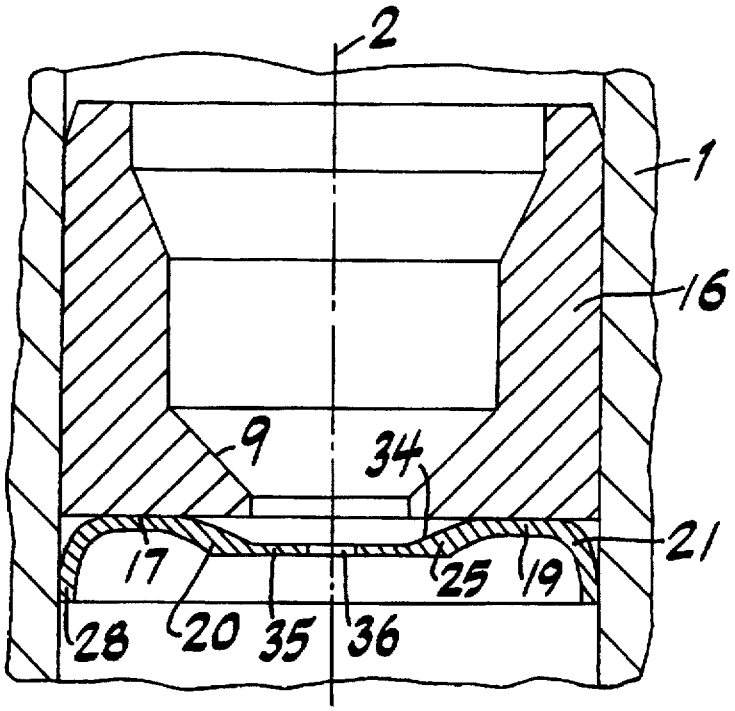
FIG. 2 shows a perforated-disk carrier with a tapered carrier section, according to the present invention.
Figure 3:
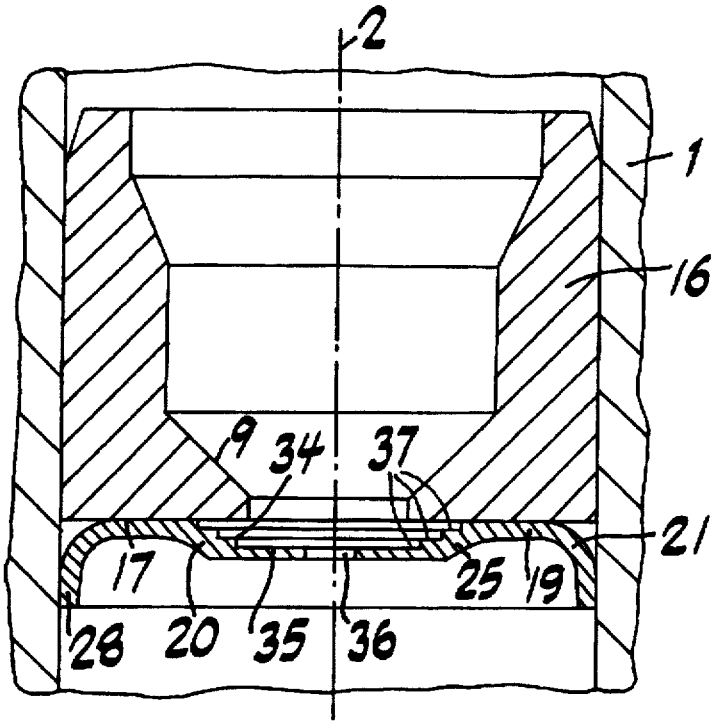
FIG. 3 shows a perforated-disk carrier with a stepped carrier section, according to the present invention.

In FIGS. 2 and 3, two exemplary embodiments of the perforated-disk carrier 21 according to the present invention are illustrated together with the valve seat body 16 in the valve seat carrier 1, the intention being primarily to illustrate the position of the components relative to one another and the shape of the perforated-disk carrier 21, for which reason the perforated disks 26 and the welds 23, 30 have been omitted from the Figures. In the first exemplary embodiment of the perforated-disk carrier 21 in FIGS. 1 and 2, the dish-shaped carrier section 25 of the bottom part 20 is of substantially conical or frustoconical design. Starting from the annular section 19 of the bottom part 20, the bottom part 20 does not continue to extend radially in contact with the lower end 17 of the valve seat body 16 but also has an axial component, giving a frustoconical taper 34 to the carrier section 25 in the direction away from the valve seat surface 9. The frustoconical taper 34 of the carrier section 25 ends at an axial distance of about 0.2 to 0.3 mm from the end 17.

Adjoining this conical taper 34 of the carrier section 25 there is then, in the direction of the valve longitudinal axis 2, once more a flat, radially extending bottom section 35, formed parallel to the annular section 19 and perpendicular to the valve longitudinal axis 2, in which a circular, elliptical or, alternatively, quadrilateral through opening 36 is made, for example, centrally. It is through this through opening 36 that the fuel sprayed from the metering perforated disk 26 ultimately emerges.

The perforated-disk carrier 21 in FIG. 3 differs from that illustrated in FIG. 2 only in the resign of the carrier section 25. On its inner side, the side facing the end 17 of the valve seat body 16, the taper 34 of the carrier section 25 is not of conical resign but step-shaped. The individual steps 37 of the carrier section 25 are here designed, for example, in such a way that the respective circular step sections decrease uniformly in diameter from the end 17 to the bottom section 35. That is to say both the axial extent of each step 37 and the extent of the reduction in diameter from one step 37 to the next step 37 should in each case be constant. Typically, three (FIG. 3) or four steps 37 are provided in the carrier section 25; however, a different number of steps 37 can readily be implemented. If the carrier section 25 is designed with four steps 37, the following gradation seems suitable, for example: 0.1 mm; 0.15 mm; 0.2 mm; 0.25 mm, these figures in each case being intended to indicate the axial distance of each step 37 from the end 17 of the valve seat body 16. In accordance with the four steps 37, it is thus possible to insert four different sizes of perforated disk 26 in the carrier section 25, which, respite the steps 37, is still basically dish-shaped. A through opening 36 is again provided in the bottom section 35 of the carrier section 25.

Figure 4:
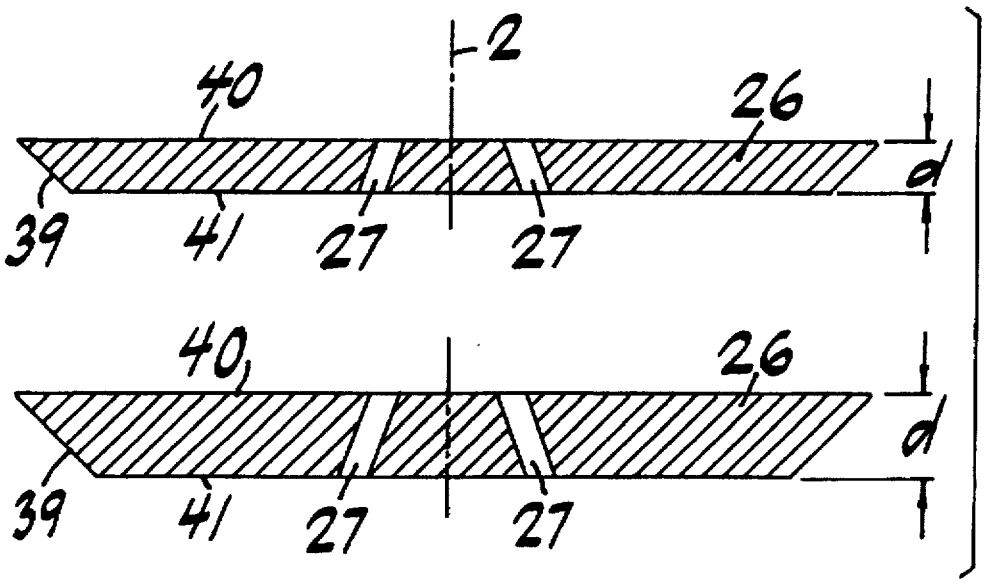
FIG. 4 shows perforated disks for the perforated-disk carrier shown in FIG. 2.

FIG. 4 illustrates the shape of the perforated disks 26 which are particularly suitable for use with perforated-disk carriers 21 in accordance with FIGS. 1 and 2. In accordance with the conical design of the carrier section 25, the perforated disks 25 also have a conical peripheral surface 39 as their outer radial boundary, and this boundary has the same slope as the frustoconical taper 34 of the perforated-disk carrier 21. Once installed, therefore, the peripheral surfaces 39 of the perforated disks 26 rest fully against the conical surface of the taper 34. In addition, a top face 40 of the perforated disk 26, the top face facing the valve seat surface 9, in each case has a diameter equal to the largest free diameter, surrounded by the annular section 19, of the carrier section 25 directly adjoining the end 17 of the valve seat body 16. The face 40 of the perforated disk 26 thus always rests against the end 17.

Accordingly, the different perforated disks 26 which can be inserted into the carrier sections 25 of the perforated-disk carrier 21 differ in their axial thickness d and hence also in the size of the conical peripheral surface 39 and in their diameter at the bottom face 41 opposite the top face 40. Depending on the axial distance from the bottom section 35 to the end 17, perforated disks 26 with thicknesses d of, for example, 0.075 mm to 0.3 mm in very fine thickness gradations can be used. The spray openings 27, of which there are, for example, four, are located, for example, symmetrically around the valve longitudinal axis 2 in the form of the corner points of a square and are thus at the same distance from one another and from the valve longitudinal axis 2 in each case.

Figure 5:
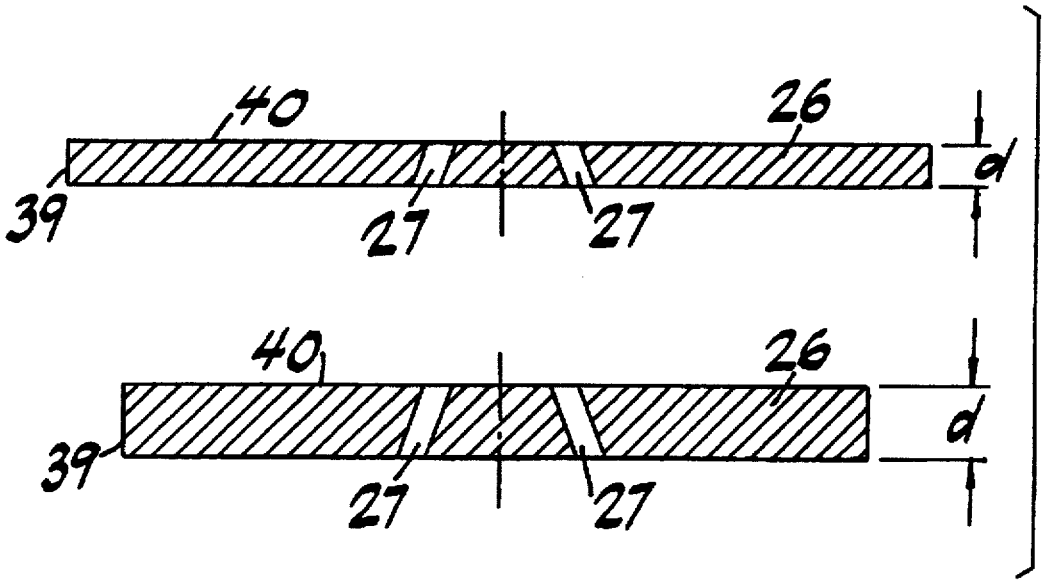
FIG. 5 shows perforated disks for the perforated-disk carrier shown in FIG. 3.

The perforated disks 26 shown in FIG. 5 are suitable particularly for use in perforated-disk carriers 21 with a stepped carrier section 25, as shown in FIG. 3. These perforated disks 26, too, again have dimensions such that, once installed, their top face 40 rests against the end 17 of the valve seat body 16. The diameter of the perforated disk 26 which can be installed thus decreases with each step 37 further downstream in the perforated-disk carrier 21, while the thickness d of the perforated disks 26 increases with each step 37 in accordance with the axial distance between the steps 37 and the end 17. In this exemplary embodiment, too, thickness d for the perforated disks 26 of 0.075 mm to 0.3 mm are conceivable; however, this must depend on the predetermined gradations in the perforated-disk carrier 21.

In order to ensure that the perforated disk 26 is clamped in the carrier section 25 of the perforated-disk carrier 21 in such a way as to be completely secure against slipping, it is preferable to make the axial distance of a step 37 from the end 17 very slightly smaller than the thickness d of the perforated disk 26 to be inserted. If the distance of the first step 37 from the end 17 is, for example, 0.1 mm, a perforated disk 26 with a thickness d of, for example, 0.105 mm or 0.11 mm is recommended. In the case of the perforated disks 26 shown in FIG. 5, the peripheral surfaces 39 run parallel to the valve longitudinal axis 2. The individual perforated disks 26 thus differ in their axial thickness 1 and in their diameter.

Figure 6:
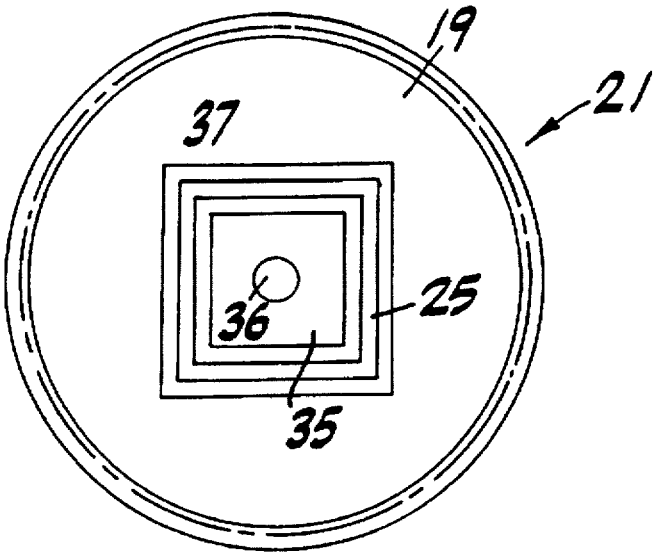
FIG. 6 shows a plan view of a perforated-disk carrier for quadrilateral perforated disks, according to the present invention.

FIG. 6 shows a perforated-disk carrier 21 in plan view, this carrier differing from those previously shown in that quadrilateral and, in particular, also square perforated disks 26 can be inserted into it. Due to the quadrilateral carrier section 25, the annular section 19 is now no longer of circular design but is distinguished on the outside by a circular boundary and on the inside by a quadrilateral boundary. However, it performs the same functions as before since the fact that it rests against the end 17 of the valve seat body 16 allows the leaktight weld 23 to be applied in a ring. In a manner similar to the frustoconical and stepped carrier sections 25 of the perforated-disk carrier 21 in FIGS. 1 to 3, the carrier sections 25 can also be designed to take quadrilateral perforated disks 26. Instead of the frustoconical taper 34, a frustopyramidal taper (not shown) can now be provided, while quadrilateral steps 37 (FIG. 6) are now formed to match the circular steps 37. The quadrilateral perforated disks 26 are varied in a manner similar to the possibilities described for the circular perforated disks 26 illustrated in FIGS. 4 and 5. It is also entirely possible for the circular through opening 36 shown in FIG. 6 to have a quadrilateral cross-section instead.

Figure 7:
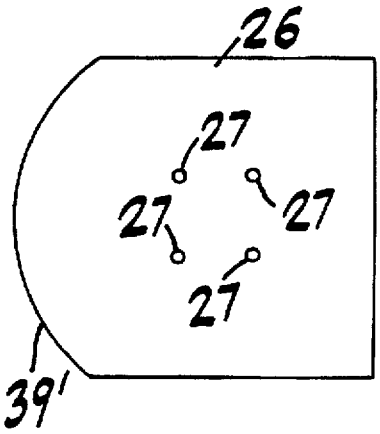
FIG. 7 shows an example of a perforated disk with means for defined installation, according to the present invention.

In order to guarantee that the installation position of the perforated disk 26 in the carrier section 25 of the perforated-disk carrier 21 is precisely defined, it is expedient to provide a quadrilateral perforated disk 26 with a peripheral surface 39' that has a radius (FIG. 7) and is then fitted exactly into a correspondingly shaped stepped section of the carrier section 25. Conversely, it is also possible to conceive of circular perforated disks 26 which have at one point a flat which then interacts with a similar flat in the carrier section 25 and thus permits defined installation.

Figure 8:
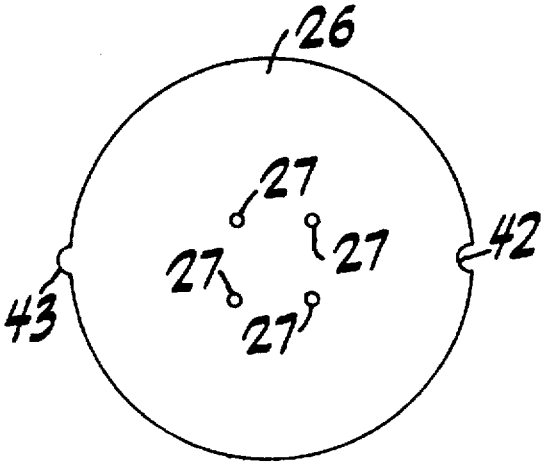
FIG. 8 shows another example of a perforated disk with means for defined installation, according to the present invention.

FIG. 8 also shows a perforated disk 26 on which means for precisely defined position fixing and securing against rotation are provided. Here, two possibilities are indicated simultaneously on the perforated disk 26 in the same Figure. On the right-hand half, the perforated disk 26 has a notch-like groove 42 into which a raised portion similar to an axial bead on the carrier section 25 can engage, while, on the left-hand side of the perforated disk 26, a raised portion 43 which runs, for example, axially and can penetrate into a groove in the carrier section 25 is provided as another variant.

Figure 9:
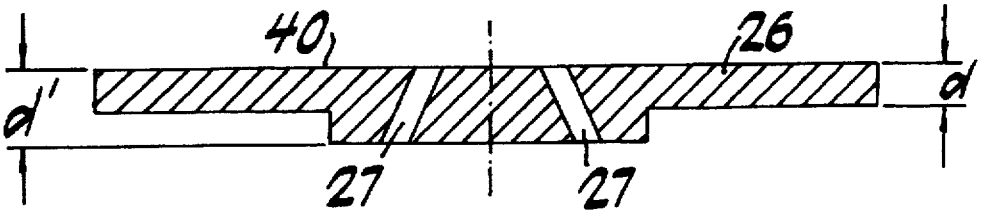
FIG. 9 shows a perforated disk with areas of different thickness, according to the present invention.

Further variants are provided, as shown in FIG. 9, by areas of differing thickness d, d' on one and the same perforated disk 26, d being intended to indicate the thickness of the perforated disk 26 at least in the area where it is clamped in the stepped section of the carrier section 25, and d' representing the thickness of the perforated disk 26 in the area of the spray openings 27.

The carrier section 25 in the bottom part 20 of the perforated-disk carrier 21, involving the formation of the frustoconical or frustopyramidal taper 34 or the step structure 37, is produced, for example, by one or more stamping operations, for which purpose the perforated-disk carrier 21 has to be clamped in a corresponding die. The same die can be used, for example, also to make the through opening 36 by means of a punch. The perforated-disk carrier 21 is fixed on the valve seat body 16 by means of the weld 23 only after the perforated disk 26, selected in accordance with the requirements, has been inserted in the dish-shaped carrier section 25 of the perforated-disk carrier 21. There is thus no fixed connection between the valve seat body 16.and the perforated disk 26.

What is claimed is:

1. A fuel injection valve for a fuel injection system of an internal combustion engine having a valve longitudinal axis, comprising:

a valve-closing element;

a valve seat body having a valve seat surface interacting with the valve-closing element;

a perforated disk being arranged downstream of the valve seat surface and having at least one spray opening; and a perforated-disk carrier having an annular section lying in a first plane, an upper surface of the annular section resting at least partially against a bottom surface of the valve seat body, the annular section being rigidly connected to the valve seat body, the perforated-disk carrier further having an inner, dish-shaped carrier section extending to a second plane axially spaced from the first plane and from the bottom surface of the valve seat body, the perforated disk being disposed between the inner, dish-shaped carrier section and the bottom surface of the valve seat body.

2. The valve according to claim 1, wherein the perforated-disk carrier is of cup-shaped design and has an encircling retention rim extending away from the valve seat body in an axial direction, a free end of the rim being connected leaktightly to an inner wall of a valve seat carrier.

3. The valve according to claim 1, wherein the annular section completely surrounds the carrier section.

4. The valve according to claim 1, further comprising means for securing the perforated disk within the perforated-disk carrier so as to prevent relative rotation of the perforated disk.

5. The valve according to claim 1, wherein, in an installed condition, the perforated disk is clamped between the carrier section and the valve seat body, and rests at least partially against the bottom surface of the valve seat body.

6. The valve according to claim 1, wherein the second plane is spaced apart from the perforated disk.

7. A fuel injection valve for a fuel injection system of an internal combustion engine having a valve longitudinal axis, comprising:

a valve-closing element;

a valve seat body having a valve seat surface interacting with the valve-closing element;

a perforated disk being arranged downstream of the valve seat surface and having at least one spray opening; and a perforated-disk carrier resting at least partially against a lower end of the valve seat body, being rigidly connected to the valve seat body, and having an inner, dish-shaped carrier section extending at an axial distance from the lower end of the valve seat body, a maximum axial distance being defined between a bottom section of the carrier section and the lower end of the valve seat body, the perforated disk being disposed between the carrier section and the lower end of the valve seat body, wherein the perforated-disk carrier has an annular section for resting the perforated-disk carrier against the valve seat body, the annular section completely surrounding the carrier section, and wherein the carrier section has a frustopyramidal taper starting at the annular section and ending at the bottom section.

8. The valve according to claim 7, wherein the perforated disk has at least one peripheral surface having the same slope as the carrier section.

9. A fuel injection valve for a fuel injection system of an internal combustion engine having a valve longitudinal axis, comprising:

a valve-closing element;

a valve seat body having a valve seat surface interacting with the valve-closing element;

a perforated disk being arranged downstream of the valve seat surface and having at least one spray opening; and a perforated-disk carrier resting at least partially against a lower end of the valve seat body, being rigidly connected to the valve seat body, and having an inner, dish-shaped carrier section extending at an axial distance from the lower end of the valve seat body, a maximum axial distance being defined between a bottom section of the carrier section and the lower end of the valve seat body, the perforated disk being disposed between the carrier section and the lower end of the valve seat body, wherein the perforated-disk carrier has an annular section for resting the perforated-disk carrier against the valve seat body, the annular section completely surrounding the carrier section, and wherein an inner side of a tapered section of the perforated-disk carrier has a plurality of steps starting from the annular section and ending at the bottom section.

10. The valve according to claim 9, wherein the inner side faces the lower end of the valve seat body.

11. The valve according to claim 9, wherein the steps in the carrier section of the perforated-disk carrier have a constant axial extension.

12. A fuel injection valve for a fuel injection system of an internal combustion engine having a valve longitudinal axis, comprising:

a valve-closing element;

a valve seat body having a valve seat surface interacting with the valve-closing element;

a perforated disk being arranged downstream of the valve seat surface and having at least one spray opening; and a perforated-disk carrier resting at least partially against a lower end of the valve seat body, being rigidly connected to the valve seat body, and having an inner, dish-shaped carrier section extending at an axial distance from the lower end of the valve seat body, a maximum axial distance being defined between a bottom section of the carrier section and the lower end of the valve seat body, the perforated disk being disposed between the carrier section and the lower end of the valve seat body, wherein the perforated-disk carrier has an annular section for resting the perforated-disk carrier against the valve seat body, the annular section completely surrounding the carrier section, and wherein the carrier section has a frustoconical taper starting at the annular section and ending at the bottom section.

* * * * *